United States Patent [19]

Kowal

[11] 4,379,399

[45] Apr. 12, 1983

[54] TUBE BENDER CONSTRUCTION

[75] Inventor: Leonard J. Kowal, Prospect Heights, Ill.

[73] Assignee: Imperial Clevite Inc., Rolling Meadows, Ill.

[21] Appl. No.: 229,863

[22] Filed: Jan. 30, 1981

[51] Int. Cl.[3] ..... B21D 9/05

[52] U.S. Cl. ..... 72/388

[58] Field of Search ..... 72/459, 458, 457, 388, 72/387, 217, 461, 32, 33, 34, 35, 36

[56] References Cited

U.S. PATENT DOCUMENTS

| | | | |
|---|---|---|---|
| 1,324,670 | 12/1919 | Hawes | 72/459 |
| 2,796,785 | 6/1957 | Philippe | 72/388 |
| 2,887,917 | 5/1959 | Kowal | 72/388 |
| 3,194,038 | 7/1965 | Small | 72/459 |
| 3,380,283 | 4/1968 | Wilson | 72/459 |
| 3,750,447 | 8/1973 | Kowal | 72/459 |
| 3,789,640 | 2/1974 | Frank | 72/36 |
| 3,926,028 | 12/1975 | Kowal | 72/388 |

*Primary Examiner*—Gene Crosby

*Attorney, Agent, or Firm*—Wood, Dalton, Phillips, Mason & Rowe

[57] ABSTRACT

A tube bender construction for manual operation in bending a tube. The tube bender includes a mandrel defining a bending groove into which the tube is urged by a forming member mounted to the mandrel to swing about a bending axis of the bending groove. The tube to be bent is held against longitudinal and rotational movement during the bending operation by tube holding structure arranged to clamp the tube against an extended groove portion of the mandrel. Movement of the forming member about the bending axis is effected by manipulation of a pair of handles. The tube clamping structure includes a hook which is swingably mounted to the mandrel and adjusting structure is provided for adjusting the disposition of the swingable hook to provide a desired clamping force of the hook against the tube. The illustrated adjusting structure includes an eccentric pin and structure for locking the pin in adjusted positions.

15 Claims, 6 Drawing Figures

TUBE BENDER CONSTRUCTION

BACKGROUND OF THE INVENTION

1. Field of the Invention

This invention relates to tube benders and in particular to manually operable tube benders wherein a forming member is swung about a bending axis of a mandrel by means of a handle associated therewith and a handle mounted to the mandrel.

2. Description of the Background Art

Manually operable tube benders are well known in the art. One improved form of such tube bender is illustrated in U.S. Pat. No. 2,796,785 of Howard L. Philippe. As shown therein, a shoe forming member is provided with a handle. The shoe is swingably mounted to a mandrel for pivotal movement about a bending axis. A second handle is connected to the mandrel. A hook is swingably mounted on the second handle for engaging the tube at a point adjacent the bend start point of a groove in the periphery of the mandrel into which the tube is urged in the bending operation.

Further improved tube benders are illustrated in U.S. Pat. Nos. 2,887,917 and 3,926,028 of the inventor herein. In U.S. Pat. No. 2,887,917, a tube bender is illustrated wherein the hook is pivotally mounted to one of the handles.

In Kowal U.S. Pat. No. 3,926,028, the tube bender is provided with a vise mounting portion in lieu of the handle secured to the mandrel. In one form, the hook is formed integrally with the male clamp portion, and in a second form, the hook is pivotally mounted thereon.

In U.S. Pat. No. 3,750,447 of the inventor herein and William R. Saddler, a further improved tube bender is illustrated having fixed hook means with a cutout space being provided in confrontation to the hook to permit facilitated installation of the tube to be bent into the tool, notwithstanding the fixed relationship of the hook to the mandrel.

SUMMARY OF THE INVENTION

The present invention comprehends an improved manually operable tube bender construction wherein the tube to be bent is held against longitudinal and rotational movement during the bending operation by an improved holding means.

More specifically, the invention comprehends the provision of means for clamping the tube adjustably against a support to hold the tube against such longitudinal displacement.

In the illustrated embodiment, the clamping means includes a hook swingably mounted to the mandrel of the bending tool so as to clamp the tube positioned on the support.

The hook is swingably mounted to the mandrel by means of a pin which is transaxially adjustable by an adjusting means to provide the desired clamping force.

More specifically, the pivot pin is eccentrically mounted to an adjustment cylinder which, in turn, is rotatively mounted in the mandrel so as to cause the pin to be moved selectively toward and from the clamping space as an incident of rotation of the mounting cylinder.

In the illustrated embodiment, a pair of mounting cylinders are provided at opposite ends of the pin for improved support of the pin in the adjustable clamping function.

Means may be provided for locking the adjusting means in the adjusted position whereby the hook is swingable about a fixed adjusted axis in the further use of the bending tool.

The adjustment of the hook may be used to provide variable clamping force corresponding to the type of tubing being bent. Alternatively, the adjustment of the hook may be utilized to take up for wear of the hook to assure a desired clamping action when the hook is swung into engagement with the tube carried on the support.

The improved tube holding means of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
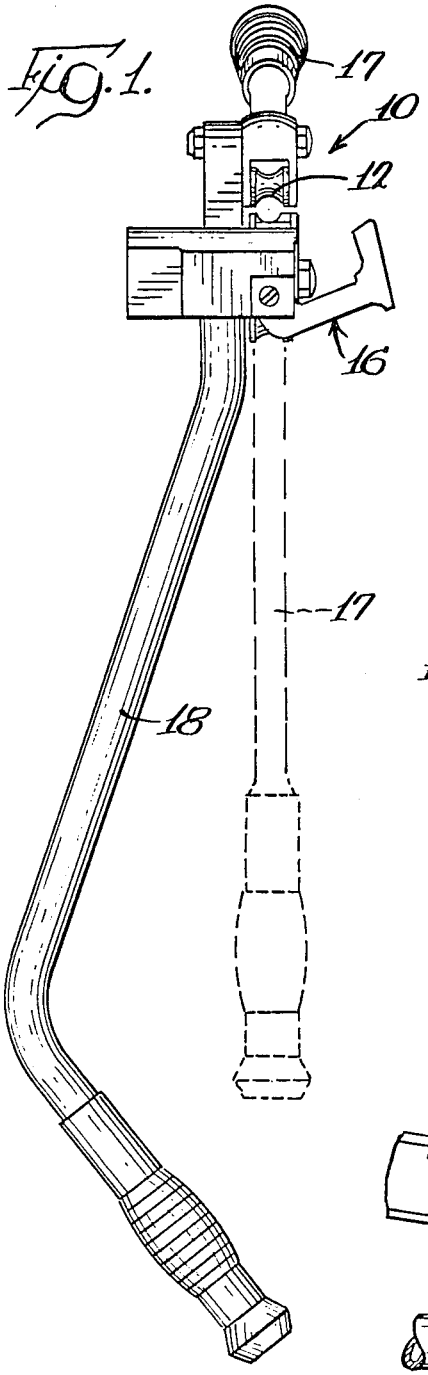
FIG. 1 is an elevation of a tube bender embodying the invention.

In the exemplary embodiment of the invention as disclosed in the drawing, a manually operable tube bender generally designated 10 is shown to include a mandrel 11 defining an annular peripheral bending groove 12. A tube to be bent T is bent into the forming groove by a forming member 13 which is swung about a bending axis 14 of the groove 12 by its connection to the mandrel through a link 15. The tube to be bent is held against longitudinal movement during the bending operation by a novel holding means generally designated 16.

Movement of the forming member 13 about axis 14 is effected by suitable manipulation of a pair of handles 17 and 18 connected respectively to the forming member 13 and mandrel 11.

Figure 2:
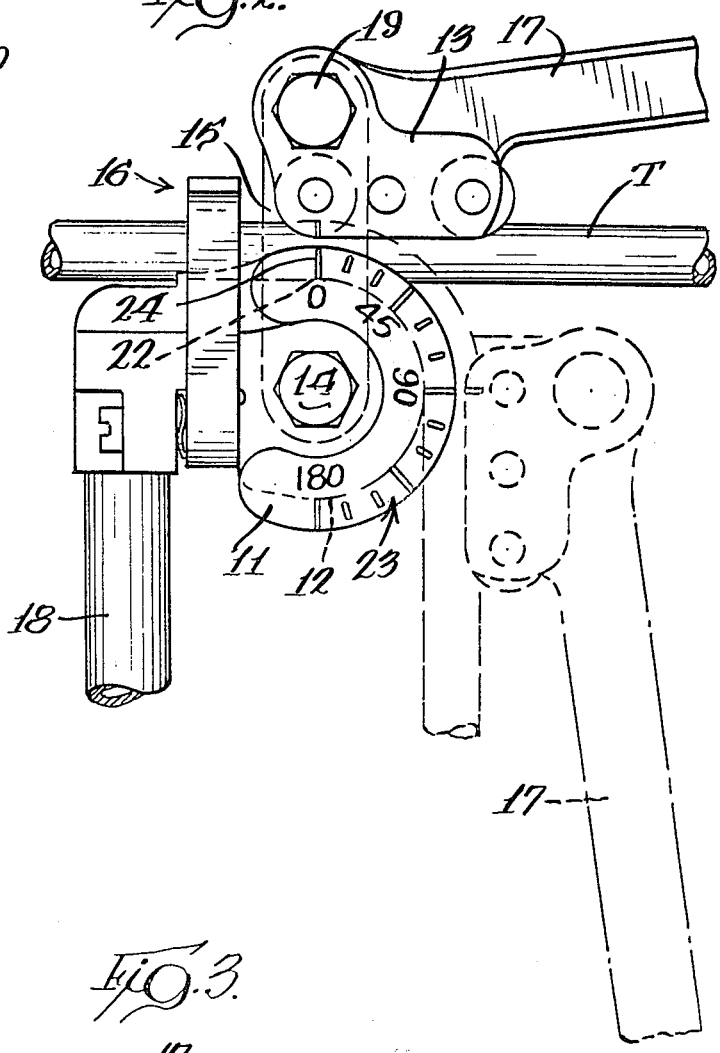
FIG. 2 is a fragmentary side elevation thereof with the forming member shown in a 90° bend position in broken lines.
Figure 3:
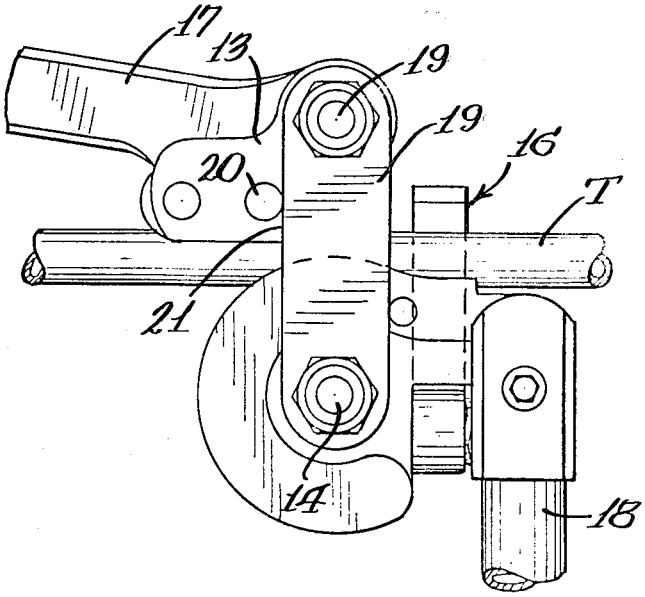
FIG. 3 is a fragmentary rear elevation thereof.

In the illustrated embodiment, handle 17 is connected to the link 15 by a pivot connection 19, which is limited in the clockwise direction of movement by the engagement of a pin 20 on the forming member engaging an edge surface 21 of the link. However, handle 17 and forming member 13 connected thereto may be swung in a counterclockwise direction from the position shown in full lines in FIG. 2 to permit facilitated insertion of the tube T into the bending groove 12 to extend perpendicularly tangentially to the bending groove at a bend start point 22 thereof. As shown in FIG. 2, the mandrel may be provided with a scale 23 having a zero indicator 24 at the bend start point 22 and other angular indications spaced correspondingly therefrom.

Figure 4:
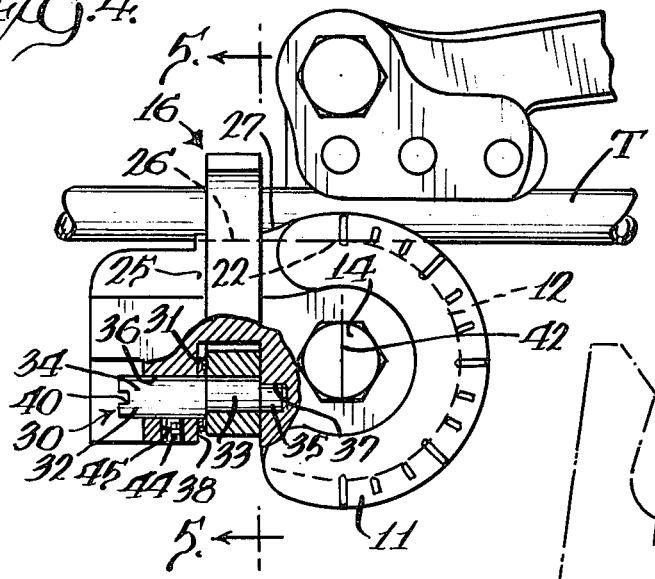
FIG. 4 is a fragmentary side elevation with portions broken away for facilitating illustration of the holding member adjusting means.

As indicated above, the invention comprehends improved means for holding tube T against longitudinal displacement during the tube bending operation effected by the manipulation of handles 17 and 18, as discussed above. As best seen in FIG. 4, mandrel 11 defines an integral extension 25 which further defines an integral extension 26 of the bending groove 12 of the mandrel. As seen in FIG. 4, bending groove extension 26 extends from the bend start point 22 rectilinearly to adjacent the holding means 16 and, thus, defines means for receiving the rectilinear tube T to be bent and holding the tube in position for coaction with the holding means 16. While the groove extension extends rectilinearly, the depth thereof may decrease outwardly toward holding means 16, as illustrated in FIG. 4 by the illustration of the top edge 27 of the groove defined by the mandrel extension portion 33.

Figure 5:
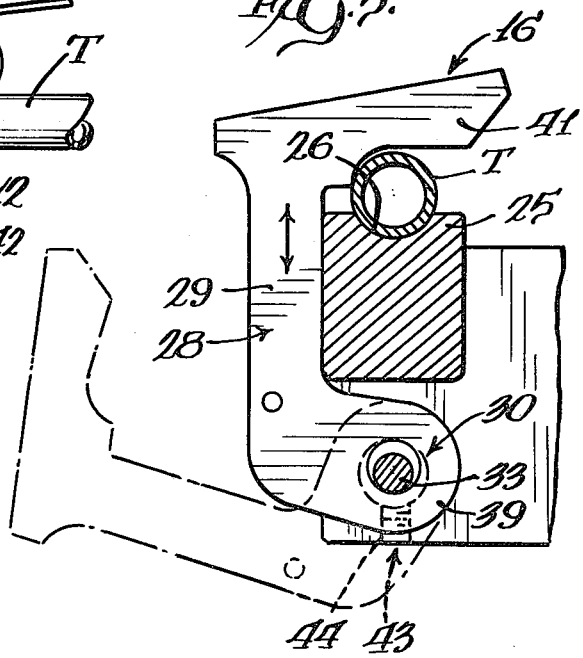
FIG. 5 is a fragmentary transverse section taken substantially along the line 5—5 of FIG. 4 with the tube holding member shown in released position in broken lines.

In the illustrated embodiment, the tube holding means 16 effectively defines a clamp for clamping the tube T to the mandrel extension 25 in the groove portion 26. More specifically, as seen in FIG. 5, holding means 16 is defined by a hook 28 having a connecting portion 29 pivotally mounted to mandrel 11 by a pivot pin means 30. A spring washer 31 may be provided for providing frictional retention of the hook against free swinging on the pivot pin.

More specifically, as illustrated in FIGS. 4 and 5, pivot pin means 30 is defined by a pin member 32 having a hook mounting portion 33 disposed between a pair of opposite coaxial end portions 34 and 35. Hook mounting portion 33 comprises a cylindrical portion having its axis spaced from the axis of the coaxially disposed end portions 34 and 35 whereby the pin member 32 defines an eccentric pin.

As shown in FIG. 4, pin ends 34 and 35 are rotatably received respectively in cylindrical openings 36 and 37 in the mandrel 11 on opposite sides of a recess 38 in which the distal end 39 of the hook connecting portion 29 is swingably received.

The outer end of pin portion 34 is provided with a transverse slot 40 for cooperating with a tool, such as a screwdriver, in effective rotative adjustment of the pin member about the longitudinal axis of portions 34 and 35 so as to swing hook mounting portion 33 in an arc thereabout. Resultingly, the pivotal mounting of hook 28 is adjusted transversely to the tube T so as to provide desired clamping force of the hook tube engaging portion 41 when the hook is swung into engagement with the tube.

More specifically, the pivot means 30 provides for adjustment of the hook in a direction generally parallel to a radius 42 from mandrel axis 14 through the bend start point 22.

The invention further comprehends the provision of locking means generally designated 43 for locking the pivot pin 30 in the adjusted position. As shown, the locking means may include a set screw 44 threaded through a threaded opening 45 in the mandrel to communicate with opening 36, permitting the set screw to lock the pin portion 34 in the adjusted disposition.

Figure 6:
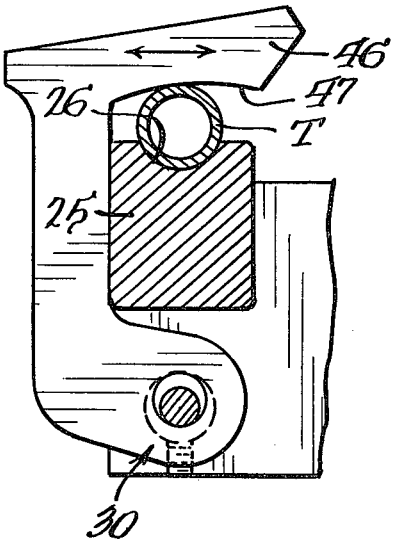
FIG. 6 is a transverse section similar to that of FIG. 5 but illustrating a modified form of tube holding member providing a wedging action in the clamping of the tube.

As shown in FIG. 6, the hook tube engaging portion 46 illustrated therein may include an arcuate tube engaging surface 47 defining a wedging surface for wedging the tube T against the mandrel extension 25 in groove extension 26 thereof.

Thus, the invention comprehends the provision of improved adjustable clamping means for holding the tube to be bent. The provision of a wedging surface on the hook further permits the hook to urge the tube forcibly against a support defined by the extension of the mandrel from the bend start point to provide improved facilitated installation and securing of the tube against longitudinal movement in the bending tool.

Thus, the clamping force exerted on the tube T may be selectively varied by the user of the tool to provide accurately preselected clamping pressure on the tubing so as to permit the tool to be used with tubing having different wall thicknesses and strength without deformation of the tube, while yet providing positive retention of the tube against displacement during the tube bending operation. Further, the improved tool holding means permits the tube to be positioned in any desired position about its longitudinal axis and maintain the held tube accurately relative to the plane of the bending groove of the mandrel and against longitudinal and rotational movement about its longitudinal axis at all times during the bending position.

Still further, the improved adjustable tube holding means permits the tube holding means to be readjusted upon wear of the tool components so as to maintain the clamping pressure at the desired values notwithstanding such wear.

In the illustrated embodiment, the hook adjusting means comprises an eccentric pin. As will be obvious to those skilled in the art, such camming adjustment may be effected by other suitable structures and it is intended that the illustrated eccentric pin hook mounting means is exemplary only of the broad concept of means for adjusting the disposition of the hook pivot axis, as desired.

The provision of the locking means 43 assures the maintenance of the pivot axis of the hook in the adjusted disposition for repeatable bending of a plurality of tubes with the preselected clamping force and disposition of the hook tube engaging means.

In use, the operator installs the tube T in the tube bender, as illustrated in FIG. 2, with the tube extending tangentially to the bending groove 12 at the bend start point 22. The hook 28 is swung into engagement with the tube to clamp the tube against mandrel extension portion 25 to lock the tube against longitudinal movement during the bending operation.

As discussed above, the disposition of the pivot axis of hook 28 is caused to be accurately the desired disposition by suitable adjustment of the pivot pin 30 to provide suitably correspondingly adjusted clamping force to the tube to be bent.

During the installation of the tube, handle 17 is swung in a counterclockwise direction from the position of FIG. 2 to space the forming means 13 from the mandrel, permitting facilitated installation of the tube T. The handle 17 is then swung in a clockwise direction to the full line position of FIG. 2. Suitable manipulation of handles 17 and 18 is then effected to move the forming means 13 circumferentially about the mandrel to effect a bending of the tube into the groove 12 to the desired angular extent, the improved tube holding means 16 positively assuring that the tube will be held against longitudinal and rotational displacement during the bending operation.

The foregoing disclosure of specific embodiments is illustrative of the broad inventive concepts comprehended by the invention.

I claim:

1. In a manually operable tube bender having a mandrel defining a tube-receiving bending groove extending arcuately about a bend axis, and a forming member mounted to said mandrel to swing about said bend axis for urging a tube to be bent into said bending groove, improved means for holding the tube against longitudinal and rotational displacement in said bending groove during a tube bending operation, said tube holding means comprising:

means for supporting a portion of the tube in a clamping space adjacent the mandrel;

a clamp member;

means for mounting the clamp member for pivotal movement into and from engagement with a tube supported by said supporting means in said clamping space to clamp the tube to the supporting means; and adjustable means for providing a selective infinite adjustment of the pivotal mounting means to adjust the disposition of the clamp member in the tube engagement disposition between maximum and minimum disposition wherein the clamp member is in engagement with the tube for adjusting the clamping force applied by said clamp member to the tube.

2. The manually operable tube bender of claim 1 wherein said means for mounting the clamp member comprises means for swingably mounting the clamp member.

3. The manually operable tube bender of claim 1 wherein said means for mounting the clamp member comprises means for swingably mounting the clamp member to the mandrel.

4. The manually operable tube bender of claim 1 wherein said means for mounting the clamp member comprises pivot means for pivotally mounting the clamp member to the mandrel.

5. The manually operable tube bender of claim 1 wherein said means for providing selective adjustment of the disposition of the pivotal mounting means comprises means for moving the clamping member toward and from said clamping space.

6. The manually operable tube bender of claim 1 wherein said means for providing selective adjustment of the disposition of the pivotal mounting means comprises means for moving the clamping member toward and from said clamping space and means for locking the pivotal mounting means in adjusted disposition.

7. In a manually operable tube bender having a mandrel defining a tube-receiving bending groove extending arcuately about a bend axis, and a forming member mounted to said mandrel to swing about said bend axis for urging a tube to be bent into said bending groove, improved means for holding the tube against longitudinal and rotational displacement during a tube bending operation, said tube holding means comprising:

means for supporting a portion of the tube in a clamping space adjacent the mandrel;

a clamp member;

pivot means for mounting the clamp member for swinging movement about a pivot axis into and from engagement with any one of a plurality of tubes successively supported by said supporting means in said clamping space to clamp each tube to the supporting means; and means for providing a selective infinite adjustment of the disposition of said pivot means transversely to the pivot axis for correspondingly adjusting the positioning of the clamp member in the tube engagement disposition wherein the clamp member is in engagement with the tube toward and from the clamping space to infinitely adjust the clamping pressure.

8. The manually operable tube bender of claim 7 wherein said means for providing selective adjustment of the pivot means comprises rotatively adjustable means.

9. The manually operable tube bender of claim 7 wherein said pivot means comprises a pivot pin rotatably mounted to said clamp member, and said means for providing selective adjustment of the pivot means comprises eccentric means mounting said pivot pin to the mandrel.

10. The manually operable tube bender of claim 7 wherein said pivot means comprises a pivot pin rotatably mounted to said clamp member, and said means for providing selective adjustment of the pivot means comprises eccentric means mounting said pivot pin to the mandrel, said tube bender further including means for selectively locking the eccentric means.

11. The manually operable tube bender of claim 7 wherein said pivot means comprises a pivot pin rotatably mounted to said clamp member, and said means for providing selective adjustment of the pivot means comprises eccentric means mounting said pivot pin to the mandrel, said tube bender further including means for selectively locking the eccentric means comprising threaded means carried by the mandrel.

12. The manually operable tube bender of claim 7 wherein said pivot means comprises a pivot pin rotatably mounted to said clamp member, and said means for providing selective adjustment of the pivot means comprises eccentric means mounting said pivot pin to the mandrel, said eccentric means comprising cylindrical elements at opposite ends of the pivot pin rotatably mounted in said mandrel.

13. The manually operable tube bender of claim 7 further including friction means for retarding free swinging movement of the clamp member.

14. The manually operable tube bender of claim 7 further including friction means for retarding free swinging movement of the clamp member acting between said clamp member and said mandrel.

15. The manually operable tube bender of claim 7 wherein said means for providing selective adjustment of the pivot means comprises rotatively adjustable means, said tube bender further including friction means for retarding free swinging movement of the clamp member acting between said clamp member and said mandrel coaxially of one of said eccentric means and said pivot pin.

* * * * *